US009427077B1

(12) United States Patent
Zhang

(10) Patent No.: US 9,427,077 B1
(45) Date of Patent: Aug. 30, 2016

(54) FOLDABLE TOOTHBRUSH WITH INTEGRATED TOOTHPASTE CONTAINER AND ORAL CARE KIT

(71) Applicant: Rui Zhang, King of Prussia, PA (US)

(72) Inventor: Rui Zhang, King of Prussia, PA (US)

( * ) Notice: Subject to any disclaimer, the term of this patent is extended or adjusted under 35 U.S.C. 154(b) by 0 days.

(21) Appl. No.: 15/050,463

(22) Filed: Feb. 22, 2016

(51) Int. Cl.
*A46B 11/00* (2006.01)
*A46B 5/00* (2006.01)
*A46B 15/00* (2006.01)

(52) U.S. Cl.
CPC ..... *A46B 11/0065* (2013.01); *A46B 5/0033* (2013.01); *A46B 5/0095* (2013.01); *A46B 11/0006* (2013.01); *A46B 11/0062* (2013.01); *A46B 15/0067* (2013.01); *A46B 15/0095* (2013.01)

(58) Field of Classification Search
CPC ..... A46B 11/0006; A46B 11/0062
USPC ..... 401/123, 125
See application file for complete search history.

(56) References Cited

U.S. PATENT DOCUMENTS

| | | | | |
|---|---|---|---|---|
| 3,734,118 | A | 5/1973 | Howard | |
| 4,467,822 | A | 8/1984 | Blackwell | |
| 5,735,298 | A * | 4/1998 | Mayne | A46B 5/005 132/309 |
| 6,945,256 | B2 * | 9/2005 | Earl | A46B 5/0033 132/311 |
| 8,800,573 | B2 | 8/2014 | Hofstad | |
| 2010/0290829 | A1 | 11/2010 | McCoy | |

* cited by examiner

*Primary Examiner* — Jennifer C Chiang

(57) ABSTRACT

A user-friendly foldable toothbrush with an integrated toothpaste container and an oral care kit are provided. The foldable toothbrush comprises a detachable toothbrush head, a toothpaste connector, a toothpaste container, a bottom housing, and a top housing. The oral care kit comprises the foldable toothbrush and a rinse cup. The foldable toothbrush and the oral care kit of the present invention are not only more convenient for users to carry and use, but are also cost-effective due to the design of certain replaceable parts.

18 Claims, 5 Drawing Sheets

FOLDABLE TOOTHBRUSH WITH INTEGRATED TOOTHPASTE CONTAINER AND ORAL CARE KIT

CROSS-REFERENCE TO RELATED APPLICATIONS

This application claims the benefit of U.S. Provisional Application No. 62/120,360, filed on Feb. 24, 2015, entitled "ORAL CARE KIT COMPRISING COLLAPSIBLE TOOTHBRUSH, INTEGRATED TOOTHPASTE CONTAINER AND RINSE CUP/CASE", the contents of which are incorporated herein by reference in their entirety, including drawings.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present invention generally relates to toothbrushes and oral care kits, more specifically, relates to a foldable toothbrush with an integrated toothpaste container and an oral care kit thereof.

2. Description of the Related Art

The following is a tabulation of some prior art that presently appears relevant:

| U.S. Patents | | | |
|---|---|---|---|
| | Kind Code | Issue Date | Patentee |
| Pat. No. | | | |
| 8,800,573 | B2 | Aug. 12, 2014 | Stein Hofstad |
| 3,734,118 | | May 5, 1973 | Frances B. Howard |
| 4,467,822 | | Aug. 28, 1984 | Victor C. Blackwell |
| Publication No. | | | |
| 20100290829 | | Nov. 18, 2010 | William McCoy |

Tooth brushing is the act of scrubbing teeth with a toothbrush equipped with toothpaste. Usually, a rinse cup is used to hold the water to rinse the toothpaste residual and to clean the toothbrush head after tooth brushing.

Traditionally, a toothbrush, a toothpaste tube/container and a rinse cup are independent. A user must open the toothpaste container, dispense the toothpaste from a tube/container onto the bristles of the toothbrush, close the toothpaste container and set it on the table: a potentially messy and time consuming process. Also, a set of traditional toothbrush, toothpaste tube/container and a rinse cup can take a lot of space in a traveler's bag, which makes tooth brushing inconvenient for travelers and people who need to carry their oral care kit around.

Thereafter, several types of toothbrushes have been designed to incorporate a toothpaste supply in their handle to simplify the dispensing operation. For example, William McCoy (US2010/0290829) discloses a device combining a toothbrush, toothpaste dispenser, and refresh cup cover. However, the device remains the same length as a normal sized toothbrush, which makes it inconvenient for traveling. And its refresh cup is too small to hold enough water for rinsing.

Foldable toothbrushes are designed to enhance the portability of toothbrushes. Stein Hofstad (U.S. Pat. No. 8,800,573 B2) discloses a foldable toothbrush with a razor. However, it lacks an integrated toothpaste container and requires a rinse cup in order for the user to brush his/her teeth, which collectively take the same amount of space as a traditional toothbrush kit in a traveler's bag. Additionally, the razor component is useless for beardless users.

Several foldable toothbrushes have integrated toothpaste designs, but still have many problems to be solved. Frances Howard (U.S. Pat. No. 3,734,118) discloses a foldable toothbrush, which dispenses toothpaste through a discharge slot registering with the brush head when in a completely folded position. The problem is obvious: firstly, it is impossible for the user to know how much toothpaste has been dispensed, which may result in a messy operation. Secondly, as the discharge slot is exposed to the air, the toothpaste dries out quickly and blocks the slot, requiring the user to consistently clean the slot. This process is both time consuming and unhygienic.

Some other foldable toothbrushes with a combined toothpaste dispenser have been proposed. Victor Blackwell (U.S. Pat. No. 4,467,822) discloses a toothbrush device comprising an elongate container for receiving or containing toothpaste. All the disclosed configurations have a piston like toothpaste dispenser, which makes it difficult or impossible to refill the toothpaste, while the manufacturing cost is high. The brush head is directly exposed to the circumstance even in inoperative position, which doesn't satisfy hygienic practices. Also, the lack of a rinse cup in the proposed design makes it inconvenient for travelers to use.

BRIEF SUMMARY OF THE INVENTION

A foldable toothbrush with an integrated toothpaste container is provided by the present invention. The foldable toothbrush comprises a detachable toothbrush head, a toothpaste connector, a toothpaste container, a bottom housing, and a top housing. The detachable toothbrush head comprises a hollow stem and a front surface in which a toothpaste output opening is configured, the hollow stem is in fluid communication with the toothpaste output opening around which bristles are configured. The toothpaste connector further comprises a toothbrush head adapter, a hose and a toothpaste container adapter. One end of the toothbrush head adapter is connected with the end of the hollow stem of the detachable toothbrush head. The other end of the toothbrush head adapter is integrally connected with the toothpaste container adapter through the hose, so that the toothpaste container adapter is in fluid communication with the toothpaste output opening. The toothpaste container has a dispensing port on one end and a toothpaste container seal on the other end. The dispensing port is fluidly connected with the toothpaste container adapter. The bottom housing has a first end and a second end. The toothpaste container sits in the bottom housing adjacent to said first end, and the first end is pivotally connected with the toothbrush head adapter via a pair of connector shafts in such a way that the detachable toothbrush head can be folded toward the bottom housing. The second end of the bottom housing contains a hinge component. In the non-use status, the detachable toothbrush head nests into said bottom housing adjacent to its second end without touching the interior face of the bottom housing. The top housing also has a first end and a second end. The first end of the top housing contains a hinge component. The first end of the top housing is hinged with the second end of the bottom housing by a pin and the hinge components; the second end of the top housing is configured with a toothbrush head adapter holder. To use the toothbrush, the top housing is clasped to the bottom housing at the toothbrush head adapter, securing the toothbrush head adapter and the detachable toothbrush head for brushing.

The present invention also provides an oral care kit which comprises the foldable toothbrush of the invention and a rinse cup. In one embodiment of the invention, the foldable toothbrush can be snugly put into the rinse cup when the foldable toothbrush is in the non-use status.

In another embodiment of the present invention, the foldable toothbrush or the oral care kit further comprises a toothbrush cap which contains a blocking rod therein. The top housing is configured with a toothbrush cap holder inside the housing, when the toothbrush is in the non-use status, the toothbrush cap is put on said detachable toothbrush head, with the blocking rod fitting into the toothpaste output opening. While in the ready-to-use status, the toothbrush cap can be fixed on the toothbrush cap holder.

In an alternative embodiment, the blocking rod is configured inside the bottom housing. When the toothbrush is in the non-use status, the blocking rod can fit into the toothpaste output opening.

In another embodiment of the present invention, the bottom housing further comprises a pair of snap fit buckles on both sides of the housing.

In another embodiment of the present invention, the toothpaste container is a refillable toothpaste container with its rear end sealed by means of said toothpaste container seal.

In an alternative embodiment, the toothpaste container is a replaceable commercial toothpaste tube.

In another embodiment of the present invention, the foldable toothbrush further comprises a pull-handle which is hinged by the pin. In a preferred embodiment of the present invention, the pull-handle is a half ring. The foldable toothbrush can stand vertically on the plane, which is defined by the half ring and the hinge components, when the top housing and bottom housing are clasped together.

In another embodiment of the present invention, the configurations of the top housing and the bottom housing are designed to keep the bristles of the foldable toothbrush from touching the surroundings when the foldable toothbrush is positioned either vertically or horizontally in the ready-to-use status.

The advantages of the present invention over prior arts include, but are not limited to, the following: (1) to provide an all-in-one oral care kit where a foldable toothbrush, integrated toothpaste dispenser and a rinse cup are compactly combined; (2) all the parts can be easily manufactured and assembled for effective and inexpensive use; (3) the rinse cup can hold enough water for rinsing, and the detachable toothbrush head is well protected in a pair of housing covers to maintain hygiene; (4) the toothpaste container is connected to the brush head to dispense paste directly to the brush head without unnecessary opening and closing of a toothpaste container lid; (5) the toothpaste output opening on the brush head is closed by a blocking rod when the brush is in an inoperative position; this configuration ensures that the paste won't dry out, and obviates the need to clean the toothpaste output opening.

As used herein, the term "ready-to-use status" or "ready to use status" refers to the status when the detachable toothbrush head of the foldable toothbrush of the present invention is fully expanded, and the top housing is clasped to the bottom housing. Accordingly, the term "non-use status" or "inoperative status" refers to the status when the detachable toothbrush head of the foldable toothbrush of the present invention is completely folded into the bottom housing, enclosed by the top housing and bottom housing, which are clasped to each other.

The objects of the present invention will become readily apparent upon further review of the following specification and drawings.

DRAWING REFERENCE NUMERALS

Figure 1:
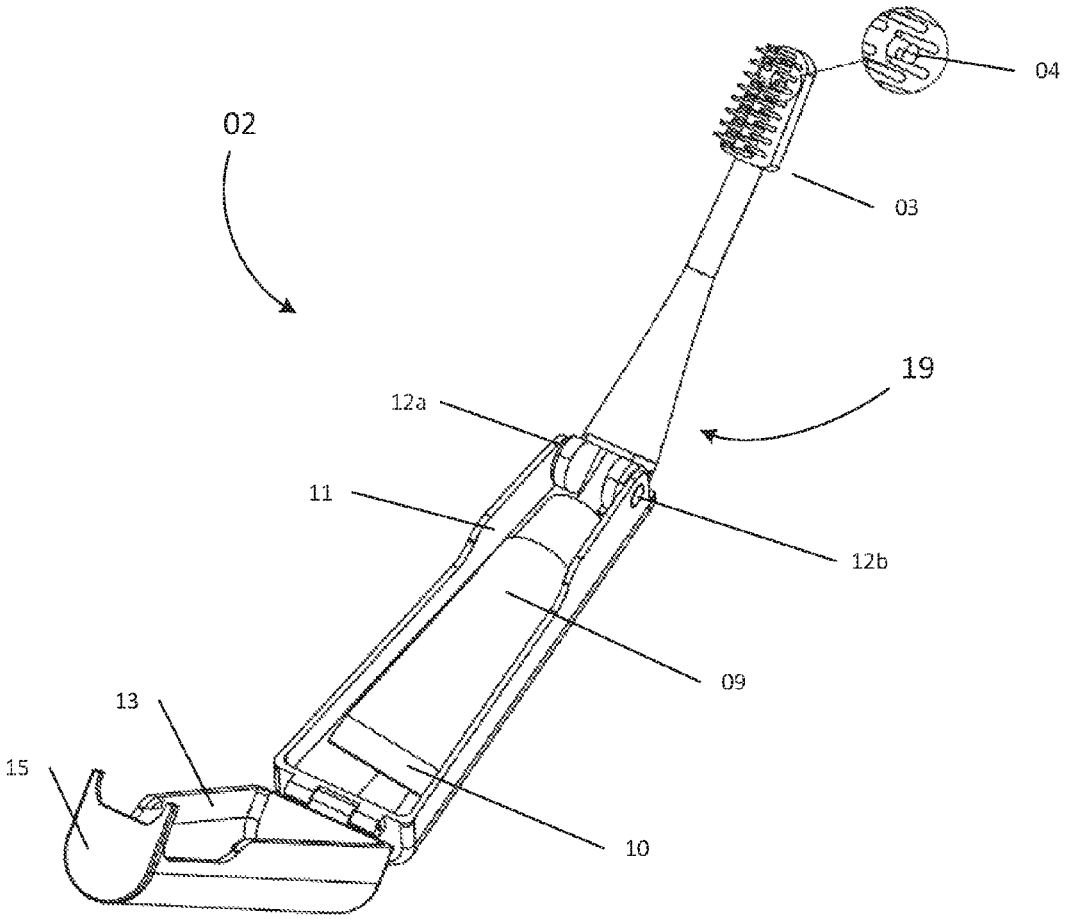
FIG. 1 is a top view of a foldable toothbrush with its top housing open, incorporating a detail view of the toothpaste output opening on the detachable toothbrush head in accordance with one embodiment of the present invention.

01. rinse cup
02. foldable toothbrush
03. detachable toothbrush head
04. toothpaste output opening
05. toothbrush head adapter
06. hose
07. toothpaste container adapter
08*a*. buckle
08*b*. buckle
09. toothpaste container
10. toothpaste container seal
11. bottom housing
12*a*. connector shaft
12*b*. connector shaft
13. top housing
14. pull-handle

15. toothbrush head adapter holder
16. pin
17. blocking rod
18. toothbrush cap
19. toothpaste connector
20. toothbrush cap holder
21. blocking rod
22. hinge component
23. hinge component

DETAILED DESCRIPTION OF THE INVENTION

With reference now to the drawings, a foldable toothbrush with an integrated toothpaste container and an oral care kit will be described in details. FIG. 1 illustrates a top view of one foldable toothbrush 02 of the present invention. The foldable toothbrush 02 comprises a detachable toothbrush head 03, a toothpaste connector 19, a toothpaste container 09, a bottom housing 11, and a top housing 13. The detachable toothbrush head 03 comprises a hollow stem and a front surface in which a toothpaste output opening 04 is configured, the hollow stem is in fluid communication with the toothpaste output opening 04 around which bristles are configured.

Figure 2:
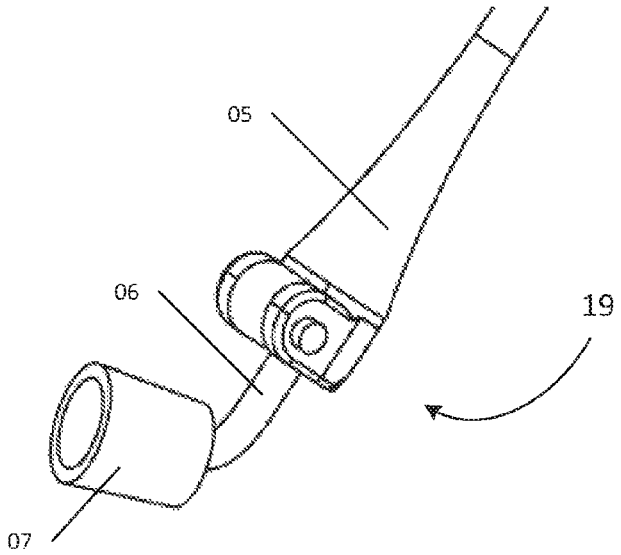
FIG. 2 shows the assembly of a toothpaste connector in accordance with one embodiment of the present invention.

As illustrated in FIG. 2, the toothpaste connector 19 comprises a toothbrush head adapter 05, a hose 06 and a toothpaste container adapter 07. One end of the toothbrush head adapter 05 is connected with the end of the hollow stem of the detachable toothbrush head 03. The other end of the toothbrush head adapter 05 is integrally connected with the toothpaste container adapter 07 through the hose 06, so that the toothpaste container adapter 07 is in fluid communication with the toothpaste output opening 04. In one embodiment of the present invention, the toothbrush head adapter 05 and the end of the hollow stem of the detachable toothbrush head 03 are connected through snap fit features.

Figure 3:
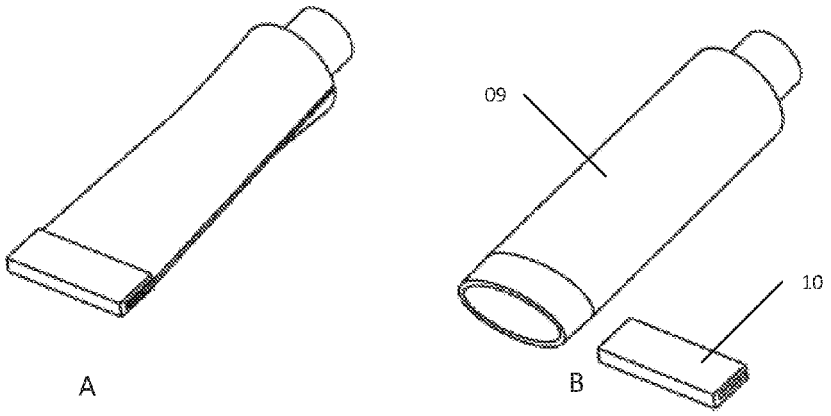
FIG. 3 shows a toothpaste container at sealed status on the left and ready-to-fill status on the right in accordance with one embodiment of the present invention.

Now referring to FIG. 3, illustrated is a perspective view of a toothpaste container 09 of one embodiment of the present invention. The toothpaste container 09 has a dispensing port on one end and a toothpaste container seal 10 on the other end. When the toothpaste is insufficient, the user can manually take down the toothpaste container seal 10 and refill the toothpaste container 09, then the rear part of the toothpaste container 09 can be sealed again using the toothpaste container seal 10. As illustrated in FIG. 1, the dispensing port is fluidly connected with the toothpaste container adapter 07. According to one embodiment of the present invention, the dispensing port and the toothpaste container adapter 07 are connected through screw threads. In the ready-to-use status, when the user presses the body of the toothpaste container 09 with a proper force, the toothpaste can be discharged onto the bristles through the toothpaste output opening 04. The bottom housing 11 has a first end and a second end. The toothpaste container 09 sits in the bottom housing 11 adjacent to said first end, and the first end is pivotally connected with the toothbrush head adapter 05 via a pair of connector shafts 12 (*a*) and 12 (*b*) in such a way that the detachable toothbrush head 03 can be folded toward the bottom housing 11. The second end of the bottom housing 11 contains a hinge component 23. In the non-use status, the detachable toothbrush head 03 nests into said bottom housing 11 adjacent to the second end without touching the interior face of the bottom housing 11. The top housing 13 also has a first end and a second end. The first end of the top housing 13 contains a hinge component 22 corresponding to the hinge component 23 of the bottom housing. The first end of the top housing 13 is hinged with the second end of the bottom housing 11 by a pin 16 and the hinge components; and the second end of the top housing 13 is configured with a toothbrush head adapter holder 15. To use the toothbrush 02, the top housing 13 is clasped to the bottom housing 11 at the toothbrush head adapter holder 15, securing the toothbrush head adapter 05 and detachable toothbrush head 03 for brushing.

In an alternative embodiment, the toothpaste container 09 is a replaceable commercial toothpaste tube. The toothpaste container adapter 07 can be designed into standard toothpaste tube threads, so that the user can replace the current toothpaste container 09 with a new toothpaste tube obtained from the market. Alternatively, the size of the toothpaste container adapter 07 also can be designed to fit different toothpaste tubes available on the market.

Figure 4:
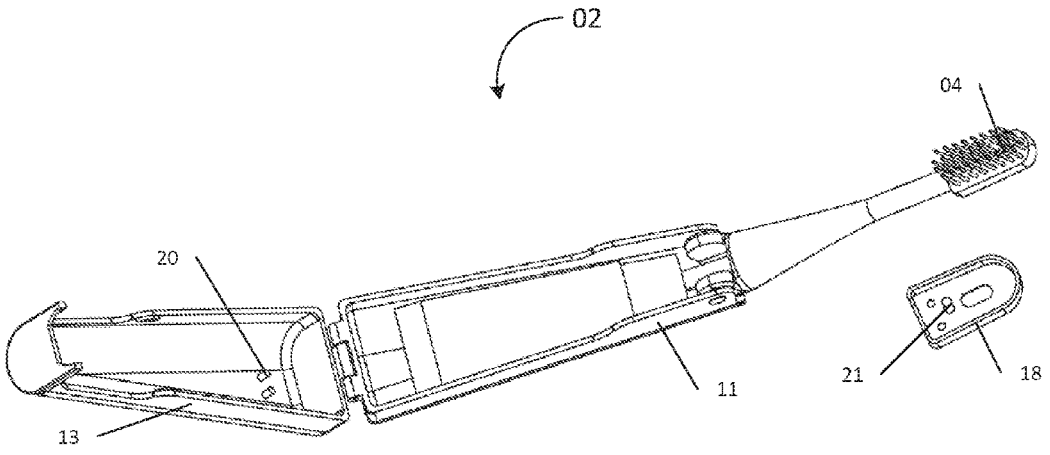
FIG. 4 shows a blocking rod in a toothbrush cap and a toothbrush cap holder in accordance with one embodiment of the present invention.

With reference to an illustrated embodiment shown in FIG. 4, the foldable toothbrush 02 further comprises a toothbrush cap 18 which contains a blocking rod 21 therein. The top housing 13 is configured with a toothbrush cap holder 20 inside the housing, when the toothbrush 02 is in the non-use status, the toothbrush cap 18 is put on said detachable toothbrush head 03, with the blocking rod 21 fitting into the toothpaste output opening 04. While in the ready-to-use status, the toothbrush cap 18 can be fixed on the toothbrush cap holder 20. As illustrated in FIG. 4 according to one embodiment of the present invention, the toothbrush cap holder 20 can be two parallel rods mounted inside the bottom of the top housing 13, and two corresponding holes are configured in the toothbrush cap 18. When the toothbrush 02 is ready to use, the toothbrush cap holder 20 can hold the protection cap 18 tightly.

Figure 5:
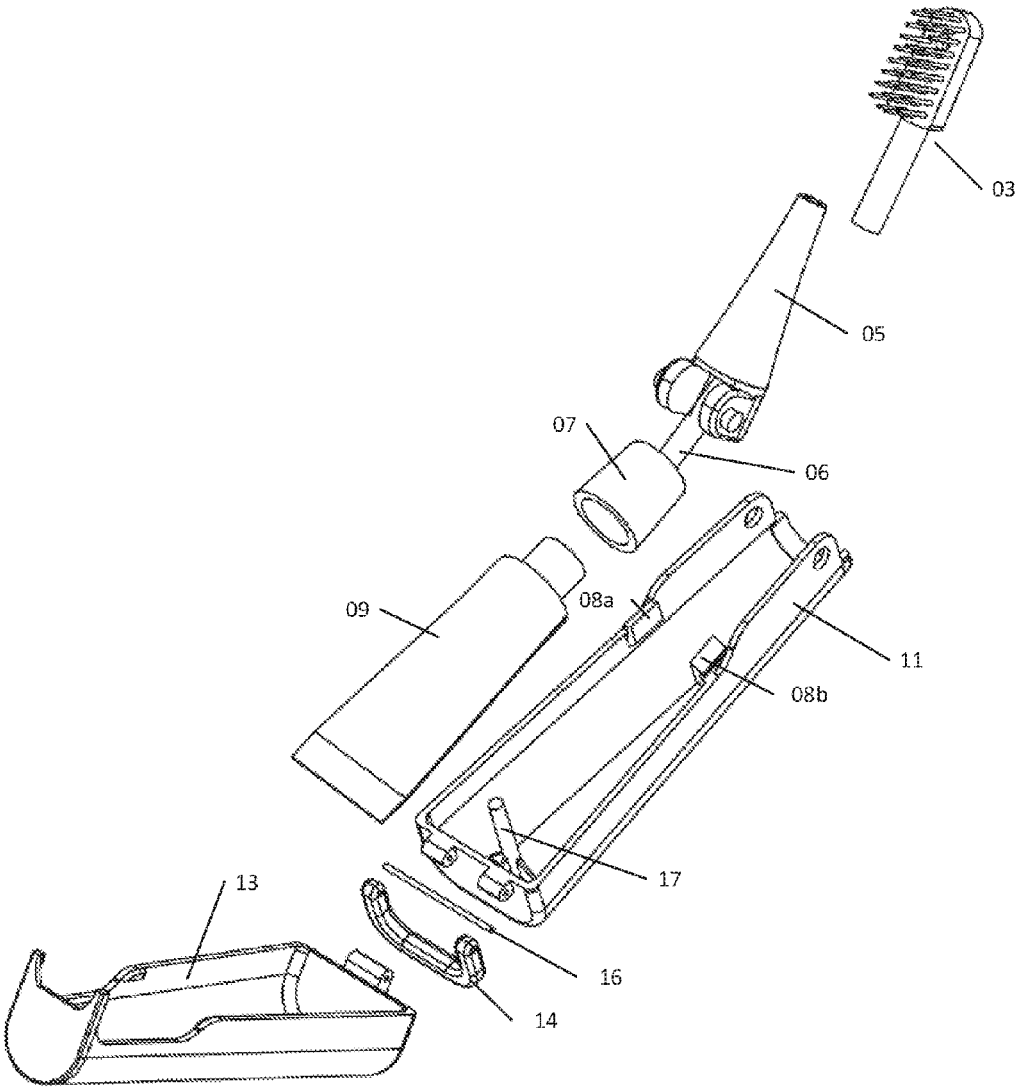
FIG. 5 is an exploded perspective view of the foldable toothbrush, showing individual parts in accordance with another embodiment of the present invention.
Figure 6:
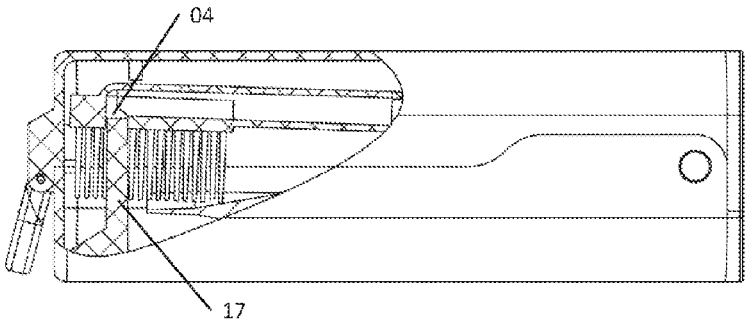
FIG. 6 is a broken-out section view of the foldable toothbrush in the non-use status with a blocking rod fitting into the toothpaste dispensing opening in accordance with one embodiment of the present invention.

In a preferred embodiment of the present invention as illustrated in FIG. 5 and FIG. 6, a blocking rod 17 is configured inside the bottom housing 11. When the toothbrush 02 is in the non-use status, the blocking rod 17 can fit into the toothpaste output opening 04.

According to one embodiment of the present invention as illustrated in FIG. 5, the bottom housing 11 further comprises a pair of snap fit buckles 08(*a*) and 08(*b*) on both sides of the housing. These two buckles can prevent the second end of the top housing 13 from releasing the first end of the bottom housing 11 after the two housings are clasped to each other. Equivalent means also could be used to achieve this objective.

Figure 7:
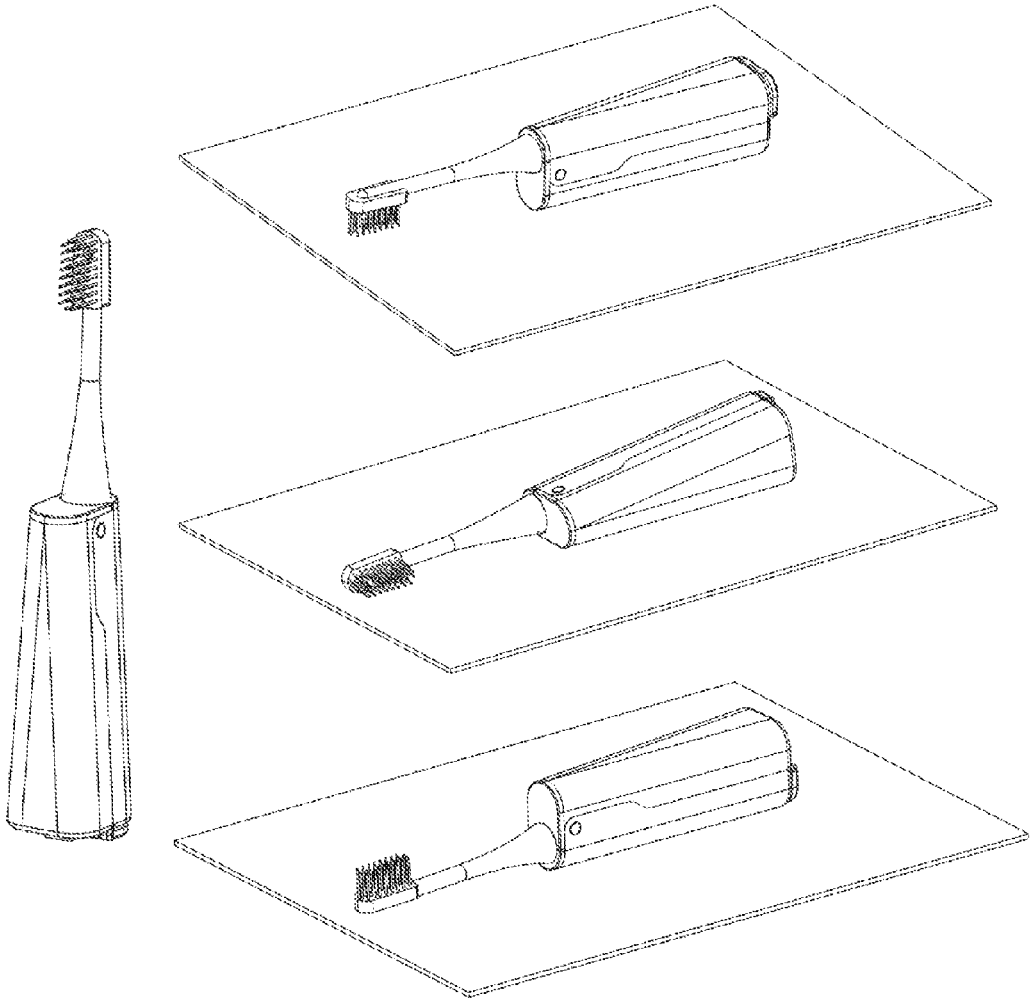
FIG. 7 shows various ways of placing the foldable toothbrush onto a surface, keeping the toothbrush bristles from touching the surface as a result of the toothbrush configuration according to one embodiment of the present invention.

In another embodiment of the present invention as illustrated in FIG. 5, the foldable toothbrush 02 further comprises a pull-handle 14 which is hinged by the pin 16. In a preferred embodiment, the pull-handle 14 is a half ring. As illustrated in FIG. 7, the foldable toothbrush 02 can stand vertically on the plane which is defined by the half ring and the hinge components, when the bottom housing 11 and top housing 13 are clasped together.

In another embodiment of the present invention as illustrated in FIG. 7, the configurations of the top housing 13 and bottom housing 11 are designed to keep the bristles of the foldable toothbrush 02 from touching the surroundings when the foldable toothbrush 02 is positioned either vertically or horizontally in the ready-to-use status.

Figure 8:
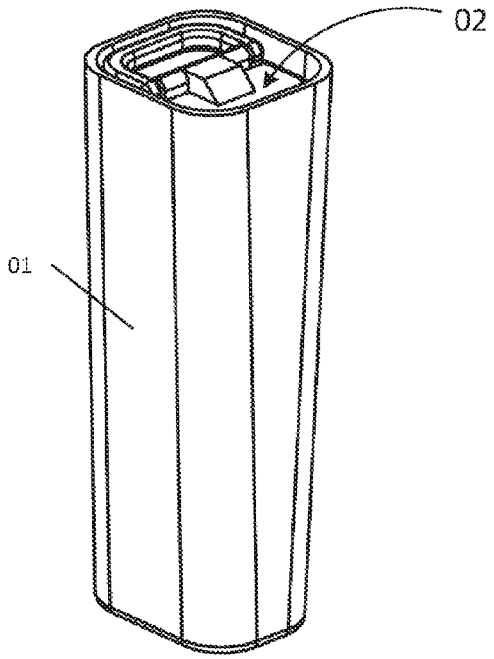
FIG. 8 is a perspective trimetric view of an oral care kit in accordance with one embodiment of the present invention, showing the side and the top of the oral care kit.
Figure 9:
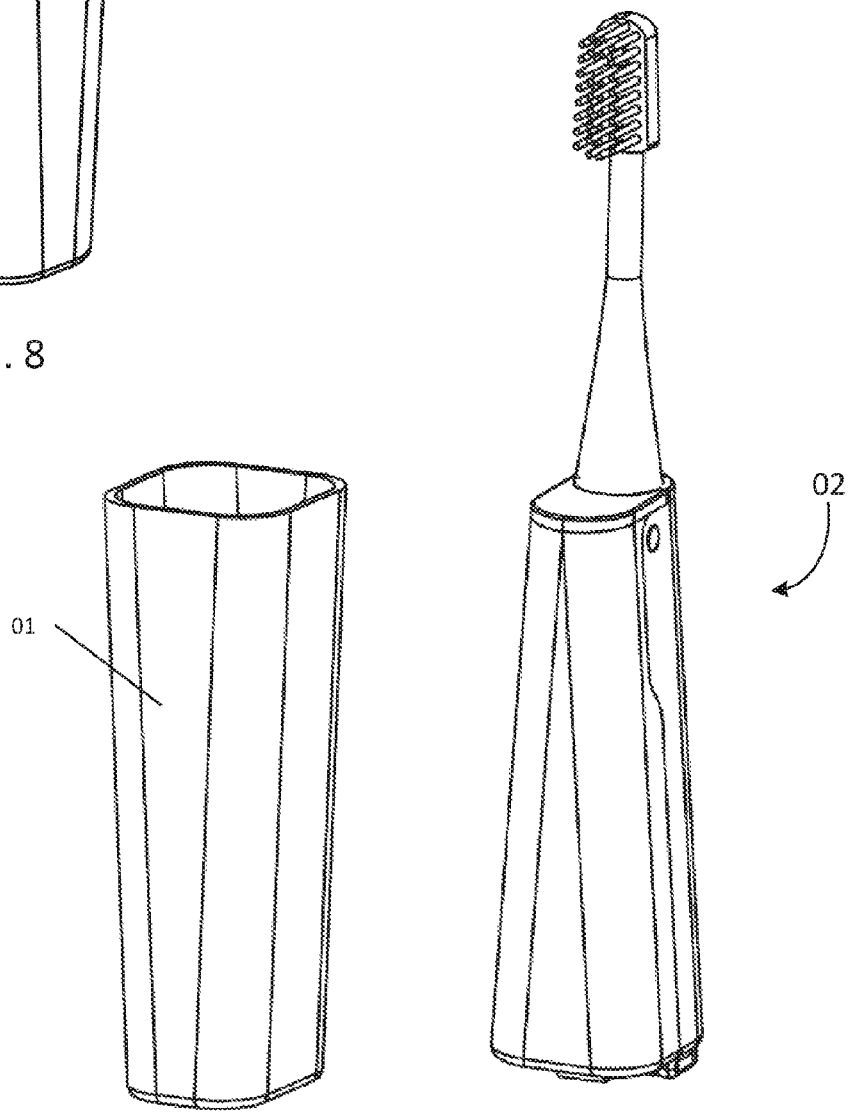
FIG. 9 is a perspective view of the oral care kit in accordance with one embodiment of the present invention, showing a rinse cup and the foldable toothbrush side by side, ready for use.

Turning to FIG. 8 and FIG. 9, illustrated is an embodiment of the oral care kit of the present invention. The oral care kit comprises the foldable toothbrush 02 of the present invention and a rinse cup 01. When the user uses the foldable toothbrush 02 to brush his or her teeth, the rinse cup 01 can be used to resin his or her mouth and clean the toothbrush 02. In the non-use status, the foldable toothbrush 02 can be snugly put into the rinse cup 01 to effectively protect the toothbrush 02 and to facilitate the carrying of the oral care kit. When the foldable toothbrush 02 is put into the rinse cup 01, the pull-handle 14 of the foldable toothbrush 02 can be seen from the opening of the rinse cup 01. Once the user wants to use the foldable toothbrush 02, he or she can use one hand to hold the rinse cup 01 and the other hand to pull the pull-handle 14, thus to easily take out the foldable toothbrush 02.

While the invention has been disclosed in connection with the preferred embodiments shown and described in details, various modifications and improvements thereon will become readily apparent to those skilled in the art. Accordingly, the spirit and scope of the present invention is not to be limited by the foregoing examples, but is to be understood in the broadest sense allowable by law.

All documents referenced herein are hereby incorporated by reference.

The invention claimed is:

1. A foldable toothbrush comprising:

a detachable toothbrush head comprising a hollow stem and a front surface in which a toothpaste output opening is configured, said hollow stem being in fluid communication with the toothpaste output opening around which bristles are configured;

a toothpaste connector further comprising a toothbrush head adapter, a hose and a toothpaste container adapter, wherein one end of said toothbrush head adapter is connected with the end of said hollow stem of the detachable toothbrush head, and the other end of said toothbrush head adapter is integrally connected with said toothpaste container adapter through said hose, so that the toothpaste container adapter is in fluid communication with said toothpaste output opening;

a toothpaste container having a dispensing port on one end and a toothpaste container seal on the other end, wherein said dispensing port is fluidly connected with said toothpaste container adapter;

a bottom housing with a first end and a second end which contains a hinge component said toothpaste container sitting in said bottom housing adjacent to said first end, wherein said first end is pivotally connected with said toothbrush head adapter via a pair of connector shafts in such a way that said detachable toothbrush head can be folded toward said bottom housing, and in the non-use status, said detachable toothbrush head nests into said bottom housing adjacent to said second end; and a top housing with a first end and a second end, said first end containing a hinge component, and the first end of said top housing being hinged with the second end of said bottom housing by a pin and the hinge components, wherein the second end of said top housing is configured with a toothbrush head adapter holder, securing said toothbrush head adapter and said detachable toothbrush head for brushing when said top housing is clasped to said bottom housing.

2. The foldable toothbrush of claim 1, wherein said bottom housing further comprises a pair of snap fit buckles in both sides of the housing.

3. The foldable toothbrush of claim 2, further comprising a toothbrush cap which contains a blocking rod therein, wherein said top housing is configured with a toothbrush cap holder inside the housing, when the toothbrush is in the non-use status, said toothbrush cap is put on said detachable toothbrush head, with the blocking rod fitting into said toothpaste output opening, and in the ready-to-use status, said toothbrush cap can be fixed onto said toothbrush cap holder.

4. The foldable toothbrush of claim 2, wherein a blocking rod is configured inside said bottom housing, when the toothbrush is in the non-use status, said blocking rod can fit into said toothpaste output opening.

5. The foldable toothbrush of claim 4, wherein said toothpaste container is a refillable toothpaste container with its rear end sealed by means of the toothpaste container seal.

6. The foldable toothbrush of claim 4, wherein said toothpaste container is a replaceable commercial toothpaste tube.

7. The foldable toothbrush of claim 1, further comprising a pull-handle which is hinged by said pin.

8. The foldable toothbrush of claim 7, wherein said pull-handle is a half ring and said foldable toothbrush can stand vertically on the plane which is formed by said half ring and the hinge components of said bottom housing and top housing when they are clasped together.

9. The foldable toothbrush of claim 8, wherein the configurations of said top housing and said bottom housing are designed to keep the bristles of said foldable toothbrush from touching the surroundings when the foldable toothbrush is positioned either vertically or horizontally in the ready-to-use status.

10. An oral care kit, comprising:

a foldable toothbrush which comprises:

a detachable toothbrush head comprising a hollow stem, and a front surface in which a toothpaste output opening is configured, said hollow stem being in fluid communication with the toothpaste output opening around which bristles are configured;

a toothpaste connector further comprising a toothbrush head adapter, a hose and a toothpaste container adapter, wherein one end of said toothbrush head adapter is connected with the end of said hollow stem of the detachable toothbrush head, and the other end of said toothbrush head adapter is integrally connected with said toothpaste container adapter through said hose so that the toothpaste container adapter is in fluid communication with said toothpaste output opening;

a toothpaste container having a dispensing port on one end and a toothpaste container seal on the other end, wherein said dispensing port is fluidly connected with said toothpaste container adapter;

a bottom housing with a first end and a second end which contains a hinge component, said toothpaste container sitting in said bottom housing adjacent to said first end, wherein said first end is pivotally connected with the said toothbrush head adapter via a pair of connector shafts in such a way that said detachable toothbrush head can be folded toward said bottom housing, and in the non-use status, said detachable toothbrush head nests into said bottom housing adjacent to said second end; and a top housing with a first end and a second end, said first end containing a hinge component, and the first end of said top housing being hinged with the second end of said bottom housing by a pin and the hinge components, wherein the second end of said top housing is configured with a toothbrush head adapter holder, securing said toothbrush head adapter and said detachable toothbrush head for brushing when said top housing is clasped to said bottom housing; and a rinse cup, wherein said foldable toothbrush can be snugly put into the rinse cup when said foldable toothbrush is in the non-use status.

11. The oral care kit of claim 10, wherein said bottom housing further comprises a pair of snap fit buckles on both sides of the housing.

12. The oral care kit of claim 11, further comprising a toothbrush cap which contains a blocking rod therein, wherein said top housing is configured with a toothbrush cap holder inside the housing, when the toothbrush is in the non-use status, said toothbrush cap is put on said detachable toothbrush head, with the blocking rod fitting into said toothpaste output opening, and in the ready-to-use status, said toothbrush cap can be fixed on said toothbrush cap holder.

13. The oral care kit of claim 11, wherein a blocking rod is configured inside said bottom housing, when the toothbrush is in the non-use status, said blocking rod can fit into said toothpaste output opening.

14. The oral care kit of claim 13, wherein said toothpaste container is a refillable toothpaste container with its rear end sealed by means of the toothpaste container seal.

15. The oral care kit of claim 13, wherein said toothpaste container is a replaceable commercial toothpaste tube.

16. The oral care kit of claim 10, further comprising a pull-handle which is hinged by said pin.

17. The oral care kit of claim 16, wherein said pull-handle is a half ring, and said foldable toothbrush can stand vertically on the plane which is formed by said half ring and the hinge components when said bottom housing and top housing are clasped.

18. The oral care kit of claim 17, wherein the configurations of said top housing and bottom housing are designed to keep the bristles of said foldable toothbrush from touching the surroundings when said foldable toothbrush is positioned either vertically or horizontally in the ready-to-use status.

* * * * *